US005702339A

United States Patent [19]

Smiley

[11] Patent Number: 5,702,339

[45] Date of Patent: Dec. 30, 1997

[54] METHOD FOR MAKING A HEAVY DUTY BAG HAVING AN EASY OPENING SPOUT

[75] Inventor: Gregory B. Smiley, Tyler, Tex.

[73] Assignee: Bonar Packaging, Inc., Tyler, Tex.

[21] Appl. No.: 790,719

[22] Filed: Jan. 31, 1997

Related U.S. Application Data

[62] Division of Ser. No. 407,979, Mar. 22, 1995, Pat. No. 5,636,925.

[51] Int. Cl.[6] ..... B31B 1/20

[52] U.S. Cl. ..... 493/196; 493/237; 493/267

[58] Field of Search ..... 493/194, 195, 493/196, 197, 199, 200, 237, 267

[56] References Cited

U.S. PATENT DOCUMENTS

| | | | |
|---|---|---|---|
| 2,499,528 | 3/1950 | Reitzes | 383/209 X |
| 3,173,603 | 3/1965 | Neuman | 229/66 |
| 3,217,770 | 11/1965 | Garth | 383/200 X |
| 3,397,835 | 8/1968 | Henning | 383/209 X |
| 3,432,986 | 3/1969 | Schneider | 493/196 |
| 3,625,351 | 12/1971 | Eisenberg | 383/207 X |
| 3,670,927 | 6/1972 | Hubbard | 383/200 X |
| 4,285,681 | 8/1981 | Walitalo et al. | 493/194 |
| 4,428,485 | 1/1984 | Egli | 383/200 X |
| 4,493,127 | 1/1985 | Blanke, Jr. et al. | 383/29 X |
| 5,226,735 | 7/1993 | Beliveau . | |
| 5,482,376 | 1/1996 | Moseley et al. . | |

FOREIGN PATENT DOCUMENTS

| | | | |
|---|---|---|---|
| 6615769 | 6/1967 | Netherlands | 383/209 |
| 7015601 | 4/1972 | Netherlands | 383/209 |

*Primary Examiner*—Jack W. Lavinder
*Attorney, Agent, or Firm*—Tobor & Goldstein, L.L.P.

[57] ABSTRACT

A plastic, heavy duty bag having an easy opening pouring spout, and a method and apparatus for forming a plastic, heavy duty bag having an easy opening pouring spout are disclosed. The bag includes a radially disposed perforation in the upper corner of the bag. Above a heat sealing strip, a slit is formed in the portion of the bag extending above the heat sealing strip, to aid in tearing through the heat seal strip to gain access to the perforation.

14 Claims, 2 Drawing Sheets

METHOD FOR MAKING A HEAVY DUTY BAG HAVING AN EASY OPENING SPOUT

This is a division, of application Ser. No. 08/407,979, filed Mar. 22, 1995, now U.S. Pat. No. 5,636,925.

BACKGROUND OF THE INVENTION

1. Field of the Invention

The invention relates to a plastic, heavy duty bag provided with an easy opening pouring spout, and a method and apparatus for making a plastic, heavy duty bag having an easy opening pouring spout. The plastic, heavy duty bags of the present invention may be used as shipping bags for any small objects that lend themselves to pouring, such as salt pellets, dog food, fertilizer, yeast, sand, and lawn and garden products such as pine bark chips, and similar products.

2. Description of the Prior Art

Many products today are distributed in plastic, heavy duty, heat sealed shipping bags, containing approximately forty (40) pounds of a particular product. Examples of products which are distributed in such plastic, heavy duty bags are: salt pellets for water softening, dog food, fertilizer, yeast, sand and/or gravel, and lawn and garden products, such as pine bark nuggets, potting soil, dirt, and similar products. The bags in which these products are distributed typically are manufactured of extruded low density polyethylene plastic film, and the upper and lower ends of the bags are heat sealed, in a conventional manner, to provide a strong and durable closure at the top and bottom of the bags. Typically such bags, upon being filled with approximately forty (40) pounds of the material to be packaged, must withstand a drop test wherein a filled bag is dropped, from a vertical distance of approximately ten (10) to twenty (20) feet, upon a hard surface, without rupturing the plastic film of the bag, or rupturing the heat sealed closure at the upper and lower ends of the bag. Typically, the present plastic, heavy duty shipping bags are formed of low density polyethylene, having a thickness of approximately 4 to 8 mils.

A major disadvantage associated with prior plastic, heavy duty bags, is that they are difficult to open, which results from the heat sealed closure of the upper and lower ends of the bag. By its design, the heat sealed closure is inherently difficult to open, because of the strength and integrity of the heat sealed closure. Typically, it is quite difficult to open prior plastic, heavy duty bags without the aid of a knife or scissors, in that it is very difficult to pull open, or manually tear the heat sealed closure, so as to open the bag to be able to pour out the material contained within the bag. If the bag is manually torn open, the plastic film typically tears open in an uneven fashion, and it is difficult to just remove a portion of the upper end, for example, to form a pouring spout at the top of the bag.

Accordingly, prior to the development of the present invention, there has been no plastic, heavy duty, heat sealed bag, which: is simple and economical to manufacture and use; is provided with a easy opening pouring spout; and is easily opened without the use of a knife or scissors.

Therefore, the art has sought a plastic, heavy duty bag and method and apparatus for making a heavy duty bag having an easy opening pouring spout, which: are simple and economical to manufacture and use; provide an easy opening pouring spout in the bag; and does not require the use of a knife or scissors to provide an easy opening pouring spout in the bag.

SUMMARY OF THE INVENTION

In accordance with the invention, the foregoing advantages have been achieve through the present plastic, heavy duty bag having an easy opening pouring spout. The present invention includes: a front wall having first and second ends and first and second side edges; a rear wall having first and second ends and first and second side edges; the front and rear walls being formed of low density polyethylene plastic film, the film having a thickness of approximately 4 to 8 mils; the front and rear walls being joined to each other along their first and second side edges; the front and rear walls being joined to each other adjacent their first ends by heat sealing together a portion of the front wall to the rear wall to provide an integral heat sealing strip disposed substantially parallel to, and spaced from, the first ends of the front and rear wall, with a skirt portion of each of the first ends of the front and rear walls extending above the heat sealing strip; the second ends of the front and rear walls adapted to be sealed together after the bag is filled with a desired product; a perforation formed in the front and rear walls and extending from the heat sealing strip to the second side edges, the perforation being substantially radially disposed from a location where the first ends and second side edges intersect; and a slit disposed in each of the skirt portions of the front and rear walls, the slits extending from the upper ends of the front and rear walls to the heat sealing strip, the slits being disposed in alignment with a portion of the perforation disposed adjacent the heat sealing strip, whereby upon pulling the skirt portions adjacent the slits, the heat sealing strip may be torn through, and further pulling separates the perforation to provide a pouring spout in the bag.

An additional feature of the present invention is that the perforation may include a plurality of openings, substantially, uniformly spaced from each other. A further feature of the present invention is that the distance between adjacent openings may be approximately 5/32 of an inch, and the openings may have a length dimension of approximately 3/32 of an inch, measured along the perforation. Another feature of the present invention is that the first side edges of the front and rear walls may be formed integrally with each other, and the second side edges of the front and rear walls are formed integrally with each other.

In accordance with another aspect of the invention, the foregoing advantages have also been achieved through the method for making a plastic, heavy duty bag of the present invention. This aspect of the present invention includes the steps of: forming a tubular shaped member of low density polyethylene plastic having a thickness of approximately 4 to 8 mils; flattening the tubular shaped member to form a front wall, having first and second ends and first and second side edges, and a rear wall having first and second ends and first and second side edges; joining the front and rear walls to each other adjacent their first ends by heat sealing together a portion of the front wall to the rear wall to provide an integral heat sealing strip disposed substantially parallel to, and spaced from, the first ends of the front and rear walls, and providing a skirt portion of each of the first ends of the front and rear walls extending above the heat sealing strip; forming a perforation in the front and rear walls extending from the heat sealing strip to the second side edges, the perforation being substantially radially disposed from a location where the first ends and second side edges intersect; and forming a slit in each of the skirt portions of the front and rear walls, the slits extending from the upper ends of the front and rear walls to the heat sealing strip, the slits being disposed in alignment with a portion of the perforation disposed adjacent the heat sealing strip, whereby upon pulling the skirt portions adjacent the slit, the heat sealing strip may be torn through, and further pulling separates the perforation to provide a pouring spout in the bag.

A further feature of this aspect of the present invention may include the step of forming the perforation with a plurality of openings, substantially uniformly spaced from each other, and the distance between adjacent openings may be approximately 5/32 of an inch. Mother feature of this aspect of the present invention may include the step of forming the openings with a plurality of slits, and disposing the slits spaced apart approximately 5/32 of an inch.

In accordance with another aspect of the invention, the foregoing advantages have also been achieved through the present method of making a plastic, heavy duty bag of the present invention. This aspect of the present invention includes the steps: forming a tubular shaped member of low density polyethylene plastic, having a thickness of approximately 4 to 8 mils; flattening the tubular shaped member to form a front wall, having first and second ends and first and second side edges, and a rear wall having first and second ends and first and second side edges; forming a perforation in the front and rear walls extending from a first location adjacent the first ends of the front and rear walls to the second side edges, the perforation being substantially radially disposed from a second location where the first ends and second side edges intersect; forming a slit in the first ends of the front and rear walls extending from the first location to the first ends of the front and rear walls, the slits disposed in alignment with a portion of the perforation disposed adjacent the first location; joining the front and rear walls to each other adjacent their first ends by heat sealing together a portion of the front wall to the rear wall to provide an integral heat sealing strip disposed substantially parallel to, and spaced from, the first ends of the front and rear walls, and providing a skirt portion of each of the first ends of the front and rear walls extending above the heat sealing strip, whereby upon pulling the skirt portions adjacent the slit, the heat sealing strip may be torn through, and further pulling separates the perforation to provide a pouring spout in the bag.

In accordance with another aspect of the invention, the foregoing advantages have also been achieved through the present apparatus for forming an easy opening spout in a heavy duty bag made of low density polyethylene plastic film having a thickness of approximately 4 to 8 mils, the bag having a top edge and a side edge and adapted to include a heat sealing strip adjacent the top edge of the bag. This aspect of the present invention includes: means for supporting an empty heavy duty bag; means for forming an arcuate shaped perforation extending from a first location adjacent the top edge of the bag to the side edge of the bag; and means for forming a slit in the top edge of the bag extending from the first location to, and through, the top edge of the bag, the slit forming means being aligned with the perforation forming means, whereby upon pulling adjacent the slit, the heat sealing strip adjacent the top edge of the bag may be torn open, and upon further pulling, the perforation is separated to form the spout.

Another feature of this aspect of the present invention is that the perforation forming means and slit forming means may be disposed for relative movement with respect to the bag supporting means. Another feature of this aspect of the present invention is that the perforation forming means may include a first arcuate knife blade having a plurality of spaced apart teeth. An additional feature of this aspect of the present invention is that the teeth may be substantially, uniformly spaced from each other to form a plurality of openings in the bag, the openings being substantially, uniformly spaced from each other. A further feature of this aspect of the present invention is that the slit forming means may be a second knife blade, and the first and second knife blades may be formed integral with each other. Another feature of this aspect of the present invention includes a means for forcing the bag away from the perforation forming and slit forming means, after the perforation and slit have been formed.

The plastic, heavy duty bag, and method and apparatus for forming a plastic, heavy duty bag having an easy opening spout of the present invention, when compared with previously proposed prior art bags and methods and apparatus, have the advantages of: being simple and economical to manufacture and use; provide a bag which may be readily opened without the use of a knife or scissors; and provide an easy opening spout in the bag.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
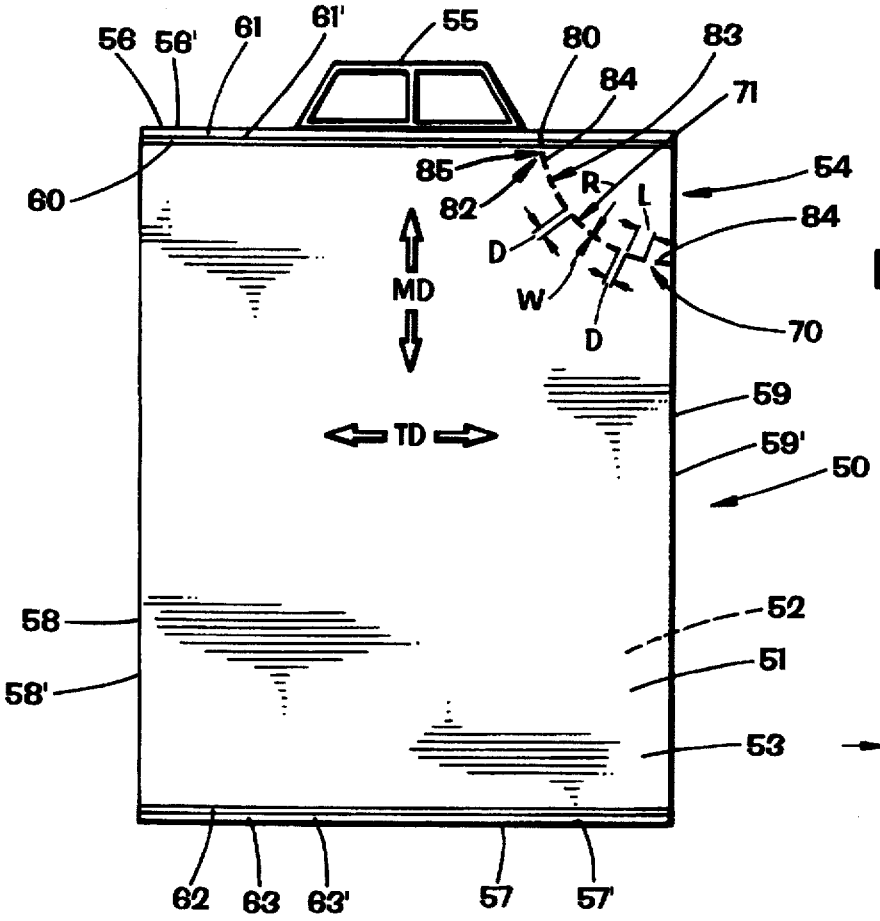
FIG. 1 is a plan view of a plastic, heavy duty bag in accordance with the present invention.

With reference to FIG. 1, a plastic, heavy duty bag 50, in accordance with the present invention, generally includes: a front wall 51; a rear wall 52; the front and rear walls 51, 52, being formed of low density polyethylene plastic film ("LDPE") 53, the thickness of the plastic film 53, being approximately 4 to 8 mils (0.004 to 0.008 inches); and an easy opening pouring spout 54. Bag 50 is designed, and has the necessary and requisite strength characteristics, to contain approximately forty (40) pounds of a desired product, such as salt pellets, fertilizer, sand and/or gravel, and any of the other materials previously described, and may be provided with a conventional carrying handle 55. The front wall 51 has first and second ends 56, 57, and first and second side edges 58, 59. Similarly, rear wall 52 has first end 56' and second end 57', and first and second side edges 58', 59', the rear wall 52, and elements thereof, being of the same size of those of front wall 51, and being disposed directly behind those elements of front wall 51. The front and rear walls 51, 52, are joined to each other along their first and second side edges 58, 58', 59, 59', and the front and rear walls 51, 52, are joined to each other adjacent their first ends 56, 56', by heat sealing together a portion of the front wall 51, to the rear wall 52 to provide an integral heat sealing strip 60 disposed substantially parallel to, and spaced from, the first ends 56, 56' of the front and rear walls 51, 52.

The heat sealing strip 60 may be provided utilizing any conventional, heat sealing equipment presently used for providing and forming similar heat sealing strips 60.

Still with reference to FIG. 1, a skirt portion 61, 61', is disposed at each of the first ends 56, 56' of the front and rear walls 51, 52, and the skirt portions 61, 61' extend above the heat sealing strip 60, as is found in conventional plastic, heavy duty bags, of the prior art. The second ends 57, 57' of the front and rear walls 51, 52, as will be hereinafter discussed, are adapted to be sealed together after the bag is filled with a desired product. Preferably, the filled bag 50 has its second ends 57, 57' heat sealed with a conventional heat sealing machine, which forms a second heat sealing strip 62 extending across the second ends 57, 57' of the front and rear walls 51, 52, as is conventional in the art, with skirt portions 63, 63' of front and rear walls 51, 52, being disposed below heat sealing strip 62, as is also conventional in the art.

A perforation 70 is formed in the front and rear walls 51, 52 of bag 50, and the perforation 70 extends from the heat sealing strip 60 to the second side edges 59, 59', of bag 50. The perforation 70 is formed in both layers of plastic film 53 of which is formed front and rear walls 51, 52. The perforation 70 is preferably substantially, radially disposed from a location 71, where the first ends 56, 56' and second side edges 59, 59' intersect. Preferably, perforation 70 is disposed at a radial distance R of approximately four inches from location 71, or the intersection of the first ends 56, 56', and second side edges 59, 59' A slit 80, or cut portion, is disposed in each of the skirt portions 61, 61' of the front and rear walls 51, 52, and the slit 80, which is preferably formed in each of the skirt portions 61, 61', extends from the upper ends of the front and rear walls 51, 52, to the heat sealing strip 60. The slit 80 is disposed in alignment with a portion 82 of the perforation 70, which is disposed adjacent to heat sealing strip 60. The portion 82 of perforation 70, with which slit 80 is aligned, is the portion of perforation 70 which is disposed directly beneath and adjacent heat sealing strip 60. Upon an individual pulling the skirt portions 61, 61' adjacent slit 80, the heat sealing strip 60 may be torn through, and further pulling separates the perforation 70 to provide the desired easy opening pouring spout 54 in bag 50. Without slit 80 formed in the skirt portions 61, 61' of bag 50, it is very difficult to tear through heat sealing strip 60 and gain access to perforation 70, to readily obtain the separation of perforation 70 to provide the easy opening pouring spout 54. Without slit 80, access to the perforation 70 has been found to be random and limited.

The perforation 70 is preferably comprised of a plurality of openings 83 substantially, uniformly spaced from each other. Preferably, the distance D between adjacent openings 83 is approximately 5/32 of an inch. Preferably, opening 83 has a length dimension L approximately 3/32 of an inch, measured along the perforation 70, as shown in FIG. 1. Preferably, openings 83 are a plurality of slits 84, with the Distance D between adjacent slits being approximately 5/32 of an inch. The use of the term "slits" to describe slits 84, is intended to mean that the length L of slits 84 is substantially greater than the width W of slits 84. As will hereinafter be described in greater detail, openings 83, or slits 84, are formed with a multi-tooth knife blade.

As previously described, the front and rear wall 51, 52 of bag 50 are preferably formed of LDPE plastic film 53 which may be formed in a conventional manner by an extrusion process. Bag 50 may be formed of two separate layers of plastic film 53, and the two separate layers, or front and rear walls 51, 52, may be heat sealed together (not shown) along their first and second side edges 58, 58', 59, 59', in a conventional manner. Preferably, bag 50 is formed with the first side edges 58, 58' of the front and rear walls 51, 52 being formed integrally with each other, and the second side edges 59, 59' of the front and rear walls 51, 52, are also formed integrally with each other. This is readily accomplished in a conventional manner, as by extruding a tubular shaped member of LDPE plastic, through the use of conventional plastic extrusion equipment, and the tubular shaped member, or continuous, elongate plastic web, is then flattened to form the front and rear walls 51, 52 with first and second side edges 58, 58', 59, 59', as shown in FIG. 1. This flattening step may be accomplished through the use of conventional equipment, as is known in the art. The flattened tubular member, or front and rear walls 51, 52 can then be passed to conventional heat sealing equipment, which forms heat sealing strip 60, which joins the front and rear walls 51, 52 to each other adjacent their first ends 56, 56', to provide the integral heat sealing strip 60, as illustrated in FIG. 1. After heat sealing strip 60 is formed, perforation 70 and slits 80 may be formed in the front and rear walls 51, 52 as previously described. Individual bags 50 may then be severed from the continuous web, in a conventional manner, and the bag 50 may be filled from the second end, or bottom, of bag 50, by conventional bag filling equipment, wherein heat sealing strip 62 may be provided. If desired, bags 50 may be provided with a carrying handle 55 which may be fixedly secured to the upper end of each bag 50 in a conventional manner, as by heat sealing carrying handle 55 to the upper end of bag 50.

Alternatively, and preferably, bags 50 may be made by forming the tubular shaped member of LDPE plastic and flattening the tubular shaped member as previously described, and thereafter, forming perforation 70 and slit 80 in the front and rear walls 51, 52. The perforation 70 is formed in the front and rear walls 51, 52 extending from a first location 85 adjacent the first ends 56, 56' of the front and rear walls 51, 52 to the second side edges 59, 59' of front and rear walls 51, 52. The perforation 70 is preferably substantially radially disposed from a second location, or location 71, as previously described. The slit 80 is formed in the first ends, or top edges, 56, 56' of the front and rear walls 51, 52, and the slit 80 extends from the first location 85 to the first ends 56, 56', or top edges, of the front and rear walls 51, 52, with the slit 80 being disposed in alignment with portion 82 of perforation 70 as previously described. Thereafter, the flattened web of plastic film 53 is then passed to a conventional heat sealing machine which joins the front and rear walls 51, 52 to each other adjacent their first ends 56, 56' to provide the integral heat sealing strip 60 as previously described. If the slit 84 of portion 82 of perforation 70, or slit 80, extends into the plastic film 53, in the region where heat sealing strip 60 is formed, the heat sealing machine will eliminate any portion of slit 80 or slit 84 appearing in the final heat sealing strip 60, due to the heating of the plastic film 53 in the region of the heat sealing strip 60, whereby a strong and effective joining of the front and rear walls 51, 52 is effected along the heat sealing strip 60.

If desired, during the manufacturing process for bag 50, a plurality of vents, or small openings, may be formed in the front and rear walls 51, 52, of bag 50, in a conventional manner. These conventional vents assist in the bag filling process for bag 50.

Still with reference to FIG. 1, it should be noted that the spacing between adjacent openings 83, or slits 84 of perforation 70, is substantially uniform. Many extruded plastic films 53 are weaker in the machine direction MD, which is the direction of extrusion of plastic film 53, than they are in the transverse direction TD across the extruded plastic film, as illustrated in FIG. 1. This means that some plastic films 53 of which bag 50 may be formed would tear more easily in the machine direction MD, than in the transverse direction TD. Thus, upon tearing through heat sealing strip 60, and upon continuing to pull apart and separate perforation 70, there could be a tendency for the tearing force to continue to extend downwardly in the machine direction MD, rather than passing downwardly in the perforation 70, and in the transverse direction TD toward the second side edges 59, 59', of bag 50. By utilizing an extruded plastic film having balanced properties in both the machine direction MD, and transverse direction TD, the tendency for the tearing force continuing to pass in the machine direction MD is avoided, whereby the tearing force is transmitted substantially evenly along, and in the direction of, perforation 70. It should be further noted that the bag 50 of the present invention requires a tearing force of approximately 2½ pounds to separate perforation 70 to provide the easy opening pouring spout 54. A substantially greater tearing force is not desirable, since it would present difficulties in opening bag 50, and with a lower tearing force there exists the potential for accidental and/or inadvertent opening of perforation 70 during shipment and handling of bag 50.

Figure 3:
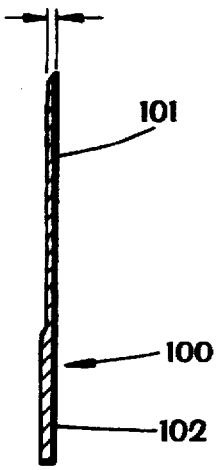
FIG. 3 is a cross-sectional view taken along line 3—3 of FIG. 2.
Figure 2:
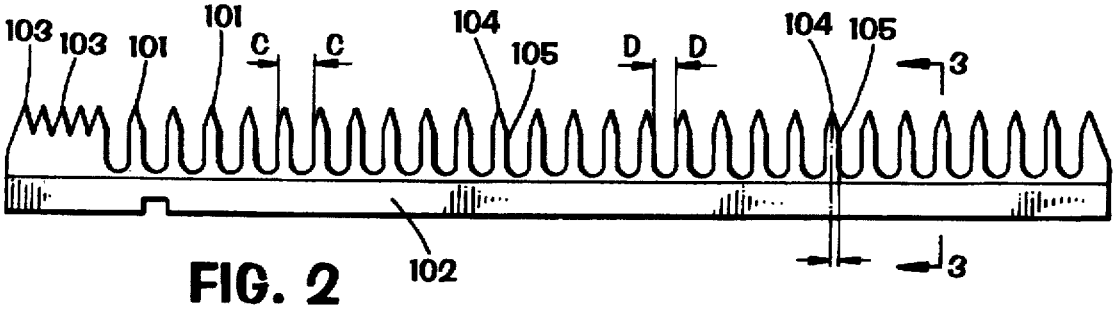
FIG. 2 is a side view of a perforation and slit forming blade in accordance with the present invention.

With reference to FIGS. 2 and 3, a knife blade 100 is illustrated, which has been found to be preferred in forming perforation 70 and slit 80 in bag 50. Knife blade 100 may be formed of any material having the requisite strength and sharpness to form perforation 70 and slits 80, such as stainless steel, carbon steel, and plastic materials. Knife blade 100 preferably has a plurality of spaced apart teeth 101, and the teeth 101 are adapted to form perforation 70. Teeth 101 are substantially uniformly spaced from each other to form the desired plurality, of openings 83, or slits 84, in bag 50. Preferably, the distance D between adjacent openings is approximately 5/32 of an inch, and the plurality of teeth 101 are on ¼ inch centers as shown at C in FIG. 2. Preferably, the width W of the individual teeth 101 is approximately 3/32 of an inch, whereby upon the use of knife 100 to form perforation 70, the slits 84 are approximately 3/32 of an inch in length, with a spacing of 5/32 of an inch between adjacent slits 84. As illustrated in FIG. 3, the width W of teeth 101 is approximately 0.013 inches and teeth 101 are integrally formed upon knife base number 102, which has a thickened cross-sectional configuration as compared to teeth 101. One end of knife 100 is provided with a plurality of closely spaced together slit forming teeth 103, which are sized to provide slit 80 in bag 50. Although it would be possible to utilize a separate knife blade having teeth 103 for forming slit 80, it is preferred that teeth 103 for performing slit 80 be provided in one integral knife blade 100, wherein a single knife blade 100 may be utilized to both form the slit 80 and the perforation 70 in bag 50. It is very important that the spacing D between adjacent teeth 101 be maintained; the spacing from the tip 104 of teeth 101 to their leading edges 105 not being as important for the formation of perforation 70 in bag 50.

Figure 4:
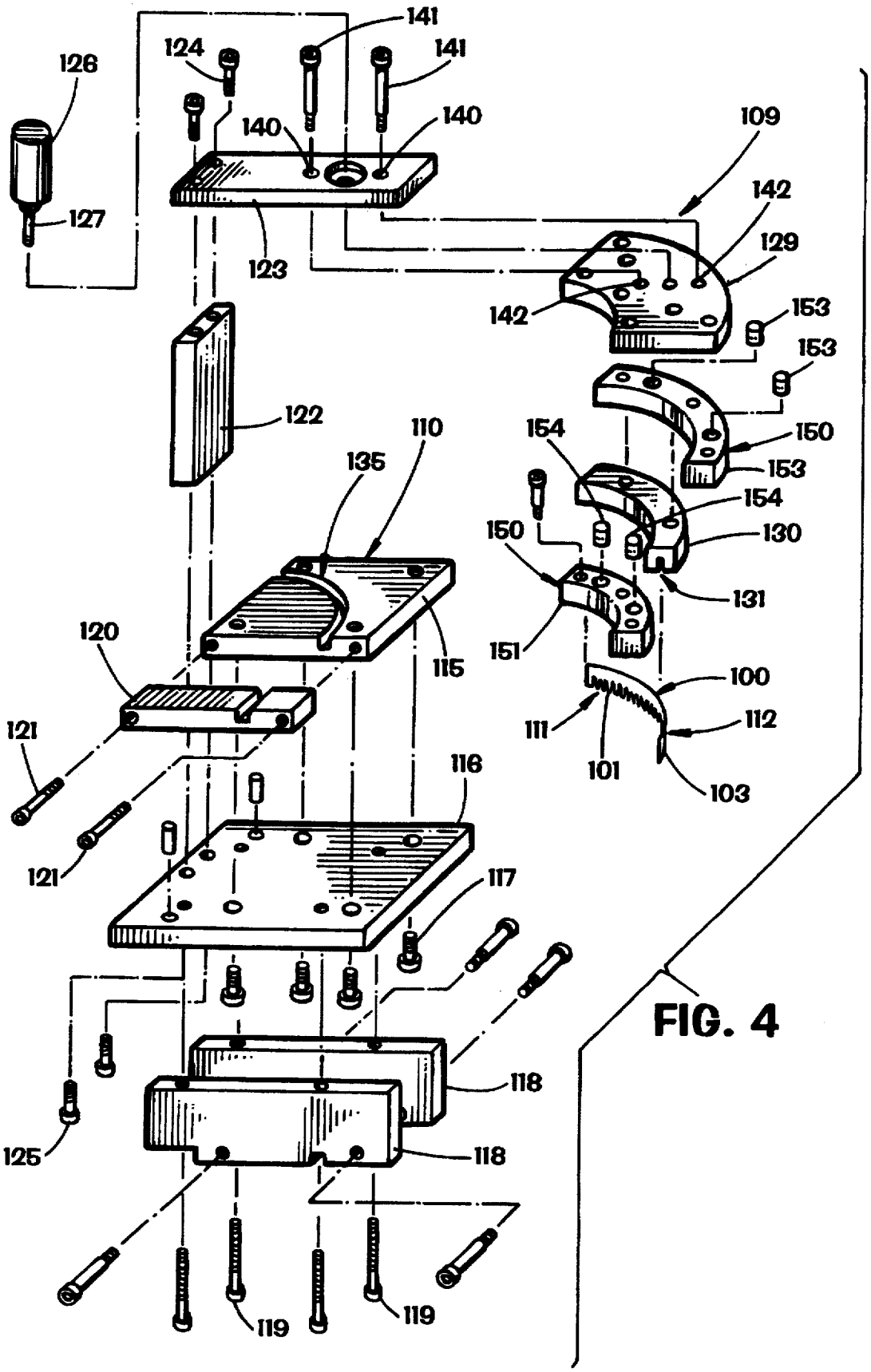
FIG. 4 is an exploded view of the apparatus in accordance with the present invention.

With reference to FIG. 4, the apparatus 104, in accordance with the present invention, for forming an easy opening spout 54 in bag 50 (FIG. 1) is shown to generally include: a means for supporting 110 an empty heavy duty bag 50; a means for forming 111 an arcuate shaped perforation 70, the perforation being previously described in connection with FIG. 1; and a means for forming 112 a slit 80 in bag 50, the slit 80 being previously described. The slit forming means 112 is aligned with the perforation forming means 111. More specifically, apparatus 109 includes a punch receiver plate 115 upon which empty bag 50 may be disposed, punch receiver plate 115 being secured to receiver base plate 116, as by bolts 117, receiver base plate 116 in turn being secured to base plate guides 118, as by bolts 119. A punch receiver block 120 is secured to punch receiver plate 115, as by bolts 121. Secured to receiver base plate 116, is a actuator mounting arm 122, which has fixedly secured thereto an actuator mounting plate 123 as by bolts 124 and 125. Fixedly secured within actuator mounting plate 123 is a pneumatic actuator 126 of conventional design having a reciprocating actuator stem 127. Pneumatic actuator 126 is received within a recess 128 formed in actuator mounting plate 123, whereby actuator stem 127 extends beneath actuator mounting plate 123. Actuator stem 127 is fixedly secured to a punch and guide mounting plate 129. A punch head 130 is secured to the underside of punch and guide mounting plate 129, and the perforation forming means and slit forming means 111, 112, or knife blade 100 as previously described in connection with FIG. 2, is fixedly secured within punch head 130, with knife blade 100 being received within arcuate groove 131 formed in punch head 130. Knife blade 100, or perforation forming means 111 and slit forming means 112, are caused to have an arcuate shape, which shape corresponds to an arcuate shaped recess 135 formed in punch receiver plate 115. Upon actuation of pneumatic actuator 126, actuator stem 127 causes relative movement between perforation forming and slit forming means 111, 112 with respect to the bag support means 110, or punch receiver plate 115, via the fixed connection between actuator stem 127 to punch and guide mounting plate 129, and in turn to punch head 130 fixedly secured to punch and guide mounting plate 129. Actuator mounting plate 128 is provided with two openings 140 through which pass guide bolts 141 which pass through mating openings 142 in punch and guide mounting plate 129, to guide and align the relative motion of punch and guide mounting plate 129 upwardly and downwardly with respect to actuator mounting plate 123 and punch receiver plate 115.

Still with reference to FIG. 4, apparatus 109 is provided with a means for forcing 150 a bag 50 away from the perforation forming and slit forming means 111, 112, after the perforation 70 and slit 80, have been formed in a bag 50. Preferably, forcing means 150 includes an inner punch guide 151 and an outer punch guide 152, the inner and outer punch guides 151, 152, being disposed adjacent the perforation and slit forming means 111, 112, or adjacent punch head 130. The inner and outer punch guides 151, 152 are spring biased toward the bag support means 110, as by springs 153 and 154, whereby inner and outer punch guides 151, 152, are biased outwardly from punch and guide mounting plate 129 in the direction toward bag support means 110, or punch receiver plate 115. Upon the actuation of pneumatic actuator 126, punch head 130 and perforation forming and slit forming means 111, 112, are forced into engagement with bag 50, and the perforation forming and slit forming means 111, 112, pass downwardly through bag 150 into the arcuate shaped groove 135 of punch receiver plate 115. Upon movement of actuator stem 127 upwardly with respect to actuator mounting plate 123, the punch head 130 and perforation forming and slit forming means 111, 112 are likewise simultaneously moved away from punch receiver plate 115. As punch head 130 travels upwardly, the springs 153, 154, which have previously been compressed by the abutment of forcing means 150, or inner and outer punch guides 151, 152, with the punch receiver plate, bias, or urge, the engagement of inner and outer punch guides 151, 152 with a bag 150 disposed upon support means 110. Inner and outer punch guides 151, 152, thus force the slit and perforated bag 50 away from the perforation forming and slit forming means 111, 112. Another bag 50, may then be disposed upon bag support means 110, whereby it can also be perforated and slit in the manner previously described.

It is to be understood that the invention is not to be limited to the exact details of construction, operation, exact materials or embodiments shown and described, as obvious modifications and equivalents will be apparent to one skilled in the art. For example, slit 80, while passing entirely through skirt portions 61, 61' of bag 50, may have other shapes, such as a zig-zag shape. Accordingly, the invention is therefore to be limited only by the scope of the appended claims.

I claim:

1. A method for making a plastic, heavy duty bag, adapted to be filled with a desired product, comprising the steps of:

(a) forming a tubular shaped member of low density polyethylene plastic having a thickness of approximately 4 to 8 mils;

(b) flattening the tubular shaped member to form a front wall, having first and second ends and first and second side edges, and a rear wall having first and second ends and first and second side edges;

(c) joining the front and rear walls to each other adjacent their first ends by heat sealing together a portion of the front wall to the rear wall to provide an integral heat sealing strip disposed substantially parallel to, and spaced from, the first ends of the front and rear walls, and providing a skirt portion of each of the first ends of the front and rear walls extending above the heat sealing strip;

(d) forming a perforation in the front and rear walls extending from the heat sealing strip to the second side edges, the perforation being substantially radially disposed from a location where the first ends and second side edges intersect; and (e) forming a slit in each of the skirt portions of the front and rear walls, the slits only extending from the first ends of the front and rear walls to the heat sealing strip, the slit being disposed substantially perpendicular to the heat sealing strip and in alignment with a portion of the perforation disposed adjacent the heat sealing strip, whereby upon pulling the skirt portions adjacent the slit, the heat sealing strip may be tom through, and further pulling separates the perforation to provide a pouring spout in the bag.

2. The method of claim 1, including the step of forming the perforation with a plurality of openings substantially uniformly spaced from each other.

3. The method of claim 2, including the step of forming the perforation with the distance between adjacent openings of approximately 5/32 of an inch.

4. The method of claim 3, including the step of forming the openings with a length dimension of approximately of an inch measured along the perforation.

5. The method of claim 1, including the step of fixedly securing a carrying handle to the first ends of the front and rear walls.

6. The method of claim 2, including the step of forming the openings with a plurality of slits, and disposing the slits with the distance between adjacent slits being approximately 5/32 of an inch.

7. The method of claim 2, including the step of forming the openings with a plurality of slits, and disposing the slits with the distance between adjacent slits being approximately 5/32 of an inch.

8. A method for making a plastic, heavy duty bag, adapted to be filled with a desired product, comprising the steps of:

(a) forming a tubular shaped member of low density polyethylene plastic having a thickness of approximately 4 to 8 mils;

(b) flattening the tubular shaped member to form a front wall, having first and second ends and first and second side edges, and a rear wall having first and second ends and first and second side edges;

(c) forming a perforation in the front and rear walls extending from a first location adjacent the first ends of the front and rear walls to the second side edges, the perforation being substantially radially disposed from a second location where the first ends and second side edges intersect;

(d) forming a slit in the first ends of the front and rear walls only extending from the first location to the first ends of the front and rear walls, the slit disposed in alignment with a portion of the perforation disposed adjacent the first location;

(e) joining the front and rear walls to each other adjacent their first ends by heat sealing together a portion of the front wall to the rear wall to provide an integral heat sealing strip disposed substantially parallel to, and spaced from, the first ends of the front and rear walls, and providing a skirt portion of each of the first ends of the front and rear walls extending above the heat sealing strip, the slits being disposed in the skirt portions, whereby upon pulling the skirt portions adjacent the slit, the heat sealing strip may be tom through, and further pulling separates the perforation to provide a pouring spout in the bag.

9. The method of claim 8, including the step of forming the perforation with a plurality of openings substantially uniformly spaced from each other.

10. The method of claim 9, including the step of forming the perforation with the distance between adjacent openings being approximately 5/32 of an inch.

11. The method of claim 10, including the step of forming the openings with a length dimension of approximately 3/32 of an inch measured along the perforation.

12. The method of claim 8, including the step of fixedly securing a carrying handle to the first ends of the front and rear walls.

13. The method of claim 9, including the step of forming the openings with a plurality of slits, and disposing the slits with the distance between adjacent slits being approximately 5/32 of an inch.

14. The method of claim 13, including the step of forming each slit with a length of approximately 3/32 of an inch measured along the perforation.

* * * * *

UNITED STATES PATENT AND TRADEMARK OFFICE

CERTIFICATE OF CORRECTION

PATENT NO. : 5,702,339

DATED : December 30, 1997

INVENTOR(S) : Gregory B. Smiley

It is certified that error appears in the above-identified patent and that said Letters Patent is hereby corrected as shown below:

In Column 9, line 41, delete "tom", and insert--torn--.

In Column 10, line 36, delete "tom", and insert--torn--.

Signed and Sealed this

Twenty-first Day of April, 1998

Bruce Lehman

*Attest:*

BRUCE LEHMAN

*Attesting Officer*

*Commissioner of Patents and Trademarks*